United States Patent [19]

Kawakami et al.

[11] Patent Number: 4,669,899

[45] Date of Patent: Jun. 2, 1987

[54] INK RIBBON CARTRIDGE AND COLOR INK RIBBON FOR PRINTER

[75] Inventors: Masanori Kawakami, Ebina; Shoji Nishiwaki, Tokyo; Hidejirou Maehara, Yokohama, all of Japan

[73] Assignee: Ricoh Company, Ltd., Tokyo, Japan

[21] Appl. No.: 813,585

[22] Filed: Dec. 26, 1985

[30] Foreign Application Priority Data

Dec. 26, 1984 [JP] Japan ..... 59-279521
Dec. 28, 1984 [JP] Japan ..... 59-278717

[51] Int. Cl.[4] ..... B41J 35/16; B41J 33/40; B41J 32/00

[52] U.S. Cl. ..... 400/240.3; 400/240.4; 400/208

[58] Field of Search ..... 400/249, 208, 240.3, 400/240.4, 235, 235.1

[56] References Cited

U.S. PATENT DOCUMENTS

| | | | |
|---|---|---|---|
| 3,961,121 | 6/1976 | Warsager | 400/240.4 |
| 3,990,043 | 11/1976 | Clark | 400/240.4 |
| 4,479,730 | 10/1984 | Yoshioka et al. | 400/249 |
| 4,492,483 | 1/1985 | Guillaume | 400/249 |
| 4,551,729 | 11/1985 | Kubo et al. | 400/240.3 |

FOREIGN PATENT DOCUMENTS

| | | | |
|---|---|---|---|
| 163285 | 12/1985 | European Pat. Off. | 400/240.4 |
| 47685 | 3/1982 | Japan | 400/208 |
| 11261 | 1/1984 | Japan | 400/240.4 |
| 209185 | 11/1984 | Japan | 400/235 |
| 2157235 | 10/1985 | United Kingdom | 400/240.4 |

OTHER PUBLICATIONS

Garwin, Improved Capacity Typewriter Ribbon, IBM Tech. Disclosure Bulletin, vol. 22, No. 8A, p. 3469, 1/80.

*Primary Examiner*—William Pieprz
*Attorney, Agent, or Firm*—Oblon, Fisher, Spivak, McClelland & Maier

[57] ABSTRACT

A ribbon cartridge includes a feed core and a takeup core around which an ink ribbon is wound. The cartridge is formed substantially symmetrically in the right-left direction and reversibly loaded in a printer. The ribbon whose width is great enough to accommodate two characters has a upper and a lower parts which each extend in the lengthwise direction of the ribbon, the upper and lower parts being usable in sequence for printing out data. A ribbon feed belt is passed over a drive roller and a pair of rollers which are located to define apexes of a triangle, remaining in frictional contact with the outer peripheries of the ribbon on the opposite cores. The drive roller drives the belt to feed the ribbon. A color ink ribbon which may be installed in the cartridge has an upper portion in which different colors are provided in a repetitive pattern in a predetermined order and a lower portion in which they are provided in a predetermined order opposite to that of the upper part, the colors appearing in the same order at a print position even when the cartridge is turned upside down.

16 Claims, 7 Drawing Figures

INK RIBBON CARTRIDGE AND COLOR INK RIBBON FOR PRINTER

BACKGROUND OF THE INVENTION

1. Field of the Invention

The present invention relates to an ink ribbon cartridge for use with a dot printer, a daisy wheel printer, a thermal printer and other printers as well as various kinds of typewriters and reciprocally fed to use upper and lower parts thereof in sequence. The present invention relates also to a color ink ribbon accommodated in such a ribbon cartridge which is detachably loaded in any of various kinds of printers, particularly a serial color thermal printer.

2. Discussion of the Background

Usually, a disposable ink ribbon housed in an ink ribbon cartridge for use with a thermal printer or like printer allows only a very small number of characters to be printed out due to the limited total length of the ribbon, requiring frequent replacement of the ribbon. Increasing the ribbon length which may be contemplated to solve the above problem brings about another problem that the diameters of pancakdes which the ribbon forms are increased, resulting in the need for a bulky ribbon cartridge.

To settle the above-stated dilemmatic situation, there has customarily been used a ribbon which has a width great enough to accommodate at least two characters and has upper and lower portions which are each defined along the length of the ribbon to be used in sequence. A prior art ribbon cartridge, therefore, has right and left portions configured symmetrically to each other. At first, an ink ribbon accommodated in such a cartridge is fed in one direction to print out data using its upper or lower portion. After the whole upper or lower half has been used up, the cartridge with the ink ribbon kept thereinside is turned upside down and, then, the ink ribbon is fed in the other direction to print our data using the other portion of the ribbon. The problem with this kind of ribbon cartridge is that since guide rollers for guiding the ink ribbon and a feed gear and a pressure gear coactive for feeding the ink ribbon are arranged in the cartridge, opposite shoulder portions of the cartridge are substantially protruded outwardly to make the whole cartridge bulky. Another problem is that since the ink ribbon is guided by way of those shoulder portions, it has to travel a substantial distance between a ribbon feed position and a print position where a thermal head is located and between a ribbon takeup position and the print position, wasting a considerable proportion of the ribbon length.

Meanwhile, where such an ink ribbon cartridge is applied to a serial color thermal printer or like printer, an ink ribbon received in the cartridge is usually provided with a color ink pattern consisting of a yellow (Y) region, a magenta (M) region and a cyan (C) region each of which extends over the whole width of the ribbon. This three-color pattern repeats itself throughout the length of the ribbon. In operation, such a color ink ribbon is fed in one direction at first to use its upper portion and, in this instance, the colors appear at the print position in a pattern or sequence of "YMC". However, while the ribbon is fed in the other direction to use its lower portion after turning over the cartridge, the colors appear in a pattern or sequence of "YCM" which is different from the previous pattern of "YMC". To print out data in purple, for example, it is the usual practice to print out magenta (M) first and, then, cyan (C) from above the magenta (M). After the cartridge has been reversed, however, cyan (C) is printed out first and, then, magenta (M) from above cyan (C). Purple attained by printing out cyan (C) over magenta (M) and purple attained by printing out the latter over the former are delicately different in tint from each other. Such is undesirable from the printout quality standpoint.

It is not impossible to cause cyan (C) to be printed out over magenta (M) even after the ribbon cartridge has been turned over. This is not without cost, however. Specifically, such an implementation would use two different patterns in printing out one line of data and, thereby, halve the effective number of characters per unit length of the ribbon when the ribbon cartridge is turned over.

SUMMARY OF THE INVENTION

It is therefore a first object of the present invention to provide an ink ribbon cartridge of the kind described which allows an ink ribbon to be used without being wasted throughout its effective length and, yet, attains a small-size configuration.

It is a second object of the present inention to provide an ink ribbon of the kind described which in a serial color thermal printer, for example, uniformalizes tints of data printed out in compound colors and prevents the effective number of characters per unit ribbon length from being reduced even in a reciprocal ribbon feed mode.

It is a third object of the present invention to provide a generally improved ink cartridge and a color ink ribbon for a printer.

In one aspect of the present invention, there is provided an ink ribbon cartridge which is reversibly loaded in a printer, provided with a width great enough to accommodate at least two characters, and used to print out characters using upper and lower parts thereof in sequence, comprising a casing having, assuming that a position where the ink ribbon makes contact with a head of the printer is an upper portion of the casing, right and left portions which are configured symmetrically to each other, an ink ribbon feed core provided in the casing for storing the ink ribbon which is wound around the core, an ink ribbon takeup core provided in the casing for taking up the ink ribbon which is paid out from the ink ribbon feed core, a ribbon feed belt frictionally engaged with outer peripheries of the ink ribbon which is wound around the cores for moving the ribbon at the same time, a belt drive roller for imparting a drive force which drives the ribbon feed belt, and a pair of belt feed rollers each located in a position to cooperate with the belt drive roller to maintain the belt in frictional contact with the outer peripheries of the ink ribbon which is wound around the cores.

In another aspect of the present invention, there is provided a color ink ribbon received in an ink ribbon cartridge which is reversibly loaded in a printer and having a width great enough to accommodate at least two characters, comprising a repetitive color pattern provided in an upper part of the ribbon in which different colors of ink are arranged in a predetermined order along a length of the ribbon, and a repetitive color pattern provided in a lower part of the ribbon in which the colors are arranged in a predetermined order which is opposite to the order of the colors provided in the upper part.

The above and other objects, features and advantages of the present invention will become more apparent from the following detailed description taken with the accompanying drawings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

While the ink ribbon cartridge and color ink ribbon for a printer of the present invention is susceptible of numerous physical embodiments, depending upon the environment and requirements of use, substantial numbers of the herein shown and described embodiments have been made, tested and used, and all have performed in an eminently satisfactory manner.

To better understand the present invention, an ink ribbon cartridge heretofore used with a printer will be described first.

Figure 1:
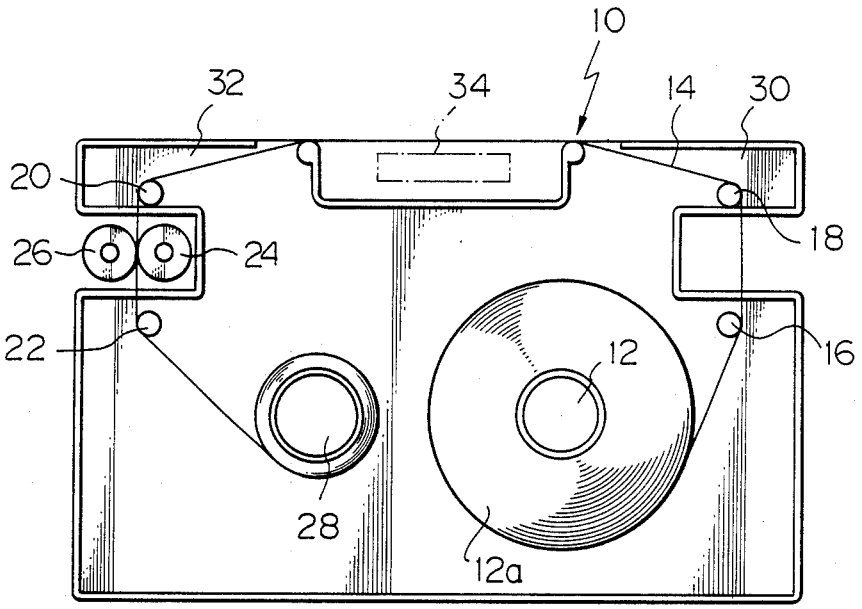
Fig. 1 PRIOR ART
FIG. 1 is a plan view showing an internal arrangement of a prior art ribbon cartridge.

Referring to FIG. 1, there is shown an example of ribbon cartridges which have customarily been mounted in thermal printers and other printers. The ribbon cartridge, generally 10, includes a feed core 12 around which an ink ribbon 14 is wound in a pancake configuration. The ink ribbon 14, which may be a one-time ribbon or thermal ribbon, is paid out from the pancake 12a and, then, guided by guide rollers 16 and 18 to the outside of the cartridge 10. Thereafter, the ink ribbon 14 is drawn into the cartridge 10 again and guided by guide rollers 20 and 22 toward a coactive feed gear 24 and a pressure gear 26, which protrude from a cartridge loading section of a printer. Fed by the gears 24 and 26, the ink ribbon 14 is taken up by a takeup core 28.

As previously discussed, a one-time ribbon or like disposable ink ribbon housed in an ink ribbon cartridge for use with a thermal printer or like printer usually allows only a very small number of characters to be printed out due to the limited total length of the ribbon, requiring frequent replacement of the ribbon. Increasing the ribbon length which may be contemplated to solve the above problem brings about another problem that the pancake of the ribbon is increased resulting in a bulky ribbon cartridge. To settle the above-stated dilemmatic situation, there has customarily been used a ribbon 14 which has a width great enough to accommodate at least two characters and has upper and lower portions which are each defined along the length of the ribbon to be used in sequence. The prior art ribbon cartridge 10, therefore, has right and left portions configured symmetrically to each other. At first, the ink ribbon 14 is fed in one direction to print out data using its upper or lower portion. After the whole upper or lower half has been used, the cartridge 10 with the ink ribbon 14 kept thereinside is turned upside down and, then, the ink ribbon 14 is fed in the other direction to print out data using the other portion.

The problem with this kind of ribbon cartridge 10 is that since the ink ribbon 14 is guided and fed by the coactive feed gear 24 and pressure gear 26, opposite shoulder portions 30 and 32 of the cartridge 10 are substantially protruded outwardly to make the whole cartridge configuration bulky. Another problem is that since the ink ribbon 14 is guided by way of those shoulder portions 30 and 32, it has to travel a substantial distance between a ribbon feed position and a print position where a thermal head 34 is located and between a ribbon takeup position and the print position, resulting in considerable waste of ribbon length.

Figure 2:
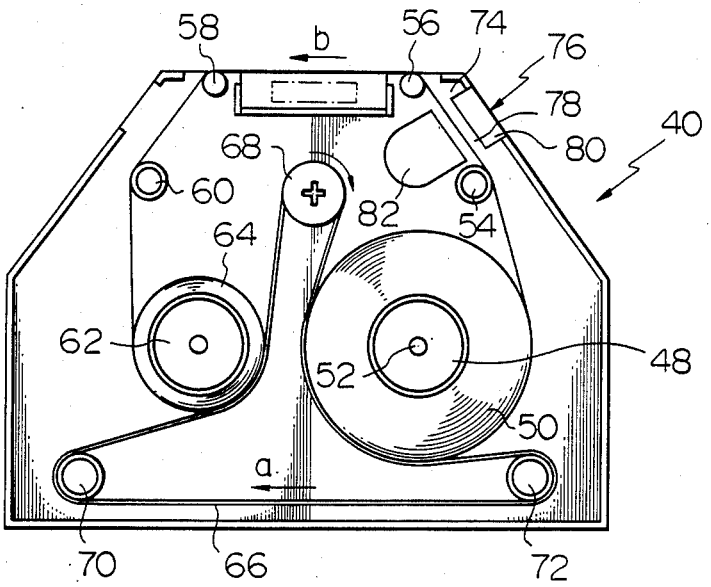
FIG. 2 is a plan view showing an internal arrangement of a ribbon cartridge in accordance with the present invention.
Figure 3:
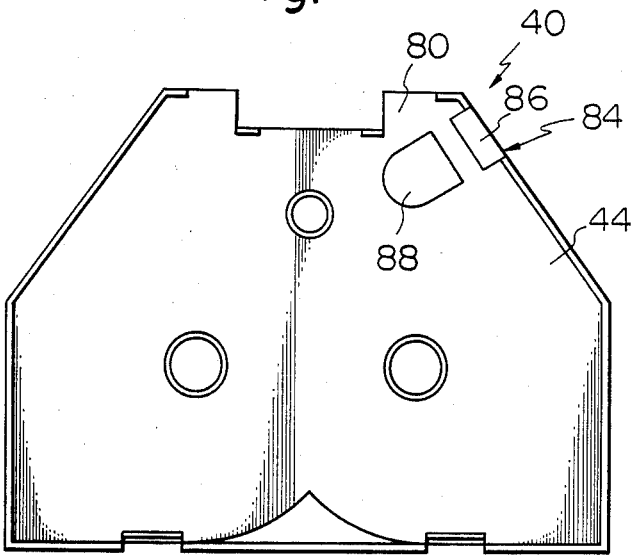
FIG. 3 is a plan view of a casing of the ribbon cartridge shown in FIG. 2.

Referring to FIGS. 2 and 3, a ribbon cartridge in accordance with the present invention is shown which is free from the drawbacks discussed above. As shown, the ribbon cartridge 40 generally comprises a casing 42 and a cover 44 adapted to cover the open top of the casing 42. An ink ribbon 46 installed in the cartridge 40, like the prior art one, has a width great enough to accommodate two characters and has vertically neighboring upper and lower portions. The ink ribbon 46 is wound around a feed core 48 inside of the cartridge 40 to form a pancake 50, which is rotatable about a spindle, or feed shaft, 52. The ribbon 46 paid out from the pancake 50 is guided by a guide roller 54 and a guide pin 56 to the outside of the cartridge 40. The ribbon 46 is then drawn into the cartridge 40 again and guided by a guide pin 58 and a guide roller 60 to be wound around a takeup core 62, forming a pancake 64. The pancake 64 on the takeup core 62 is rotatable about a takeup core 62 which stands upright on the casing 42. That part of the ribbon 46 which spans the spacing between the guide pins 56 and 58 is used to print out data.

In this particular embodiment, an endless ribbon feed belt 66 is pressed against the outer peripheries of the feed pancake 50 and takeup pancake 64 as illustrated. The belt 66 may be made of rubber, for example. The belt 66 has a width which may be equal to or half the width of the ribbon 46. The belt 66 is passed over a drive roller 68 and belt rollers 70 and 72 in a generally triangular configuration. When the cartridge 40 is loaded in a printer, the drive roller 68 will be operatively connected to a ribbon feed motor of the printer by an implementation which is known in the art. The rotation of the ribbon feed motor is transmitted to the drive roller 68 to rotate it clockwise as viewed in FIG. 2, thereby feeding the ribbon feed belt 66 as indicated by an arrow a. The belt 66 which is frictionally engaged with the ribbon 46 feeds the ribbon 46 in a direction indicated by an arrow b.

As described above, the ribbon cartridge 40 in accordance with the present invention feeds the ribbon 46 at the central part thereof. Hence, the opposite shoulder portions of the cartridge 40 are sloping in contrast to the outwardly protruding ones of the prior art ribbon cartridge. A transmission type ribbon end sensor 76 is located in the right shoulder portion 74 of the casing 42.

The ribbon end sensor 76 comprises a light-emitting element and a light-sensitive element (not shown) which respectively are received in housing portions 80 and 82 which are defined in the casing 42 at opposite sides of a ribbon feed space 78. When the light-sensitive element has sensed light issuing from the light-emitting element, it produces a ribbon end output.

The ribbon cartridge 40 includes another ribbon end sensor 84 which is provided in the right shoulder portion 80, as viewed in FIG. 3, of the cover 44. The ribbon end sensor 84 may be implemented with housing portions 86 and 88 which are similar to the housing portions 80 and 82. The ribbon cartridge 40 is substantially symmetrical in the right-left direction so that after the cover 44 and the casing 42 are put together, the cartridge 40 is usable even in the upside-down position.

Figure 4:
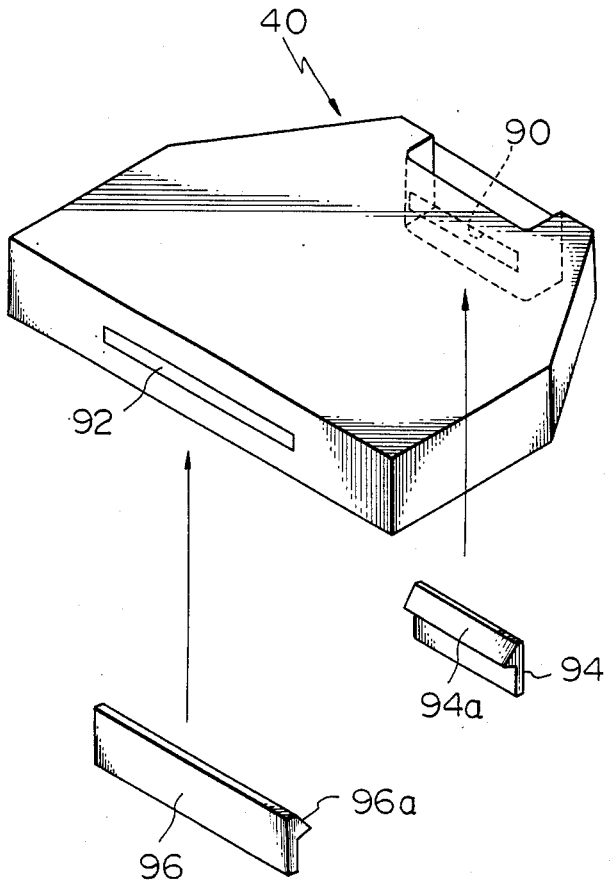
FIG. 4 is a view representative of a condition for mounting the ribbon cartridge shown in FIGS. 2 and 3.

As shown in FIG. 4, the ribbon cartridge 40 is provided with slots 90 and 92 at a front end portion and a rear end portion thereof, respectively. The printer, on the other hand, is provided with upright elastic pieces 94 and 96. Locking portions 94*a* and 96*a* extend respectively from the upper ends of the elastic pieces 94 and 96 toward each other. In this construction, the cartridge 40 is detachably mounted in the printer with the slots 90 and 92 receiving the locking portions 94*a* and 96*a* of the elastic portions 94 and 96, respectively.

After the ribbon cartridge 40 has been loaded in the printer as described above, the ink ribbon 46 is fed and taken up in the previously stated manner to use its lower half. When the lower half of the ribbon 46 has been used over the whole length, the cartridge 40 with the ribbon 46 kept therein is removed from the printer, then turned over, and then loaded in the printer again. In this condition, the ribbon 46 is fed from the takeup core 62 toward the feed core 48 so that data are printed out using the upper half of the ribbon 46 which is now located below the lower half.

In the illustrative embodiment, the ribbon end sensor 76 is located in the right shoulder portion 74 of the casing 42 and another sensor 84 in the cover 44. It should be noted, however, that the present invention is applicable to a ribbon cartridge which includes various structural elements other than ribbon end sensors so long as it has a substantially symmetrical configuration which allows an ink ribbon to be used in the same position even when the cartridge is reversed as described.

As described hereinabove, in this particular embodiment, a ribbon cartridge which is usable in an upside-down position feeds an ink ribbon at a central area thereof, instead of the prior art ribbon feed which occurs at a shoulder portion of a cartridge, using an endless ribbon feed belt which replaces the feed gear and others of the prior art cartridge, therefore, can have sloping shoulders which further enhance small-size ribbon cartridge design. In addition, the cartridge in the illustrative embodiment shortens the distance between the ribbon feed position and the print position and the distance between the ribbon takeup position and the print position, thereby eliminating wasteful use of the ribbon. This makes it possible to shorten the distance between, for example, a ribbon sensor and the print position so that the sensor may effectively exhibit its function intended for various kinds of ink ribbons.

Next, an ink ribbon which may be installed in the ink ribbon cartridge in accordance with the above embodiment of the present invention will be described in detail.

Figure 5:
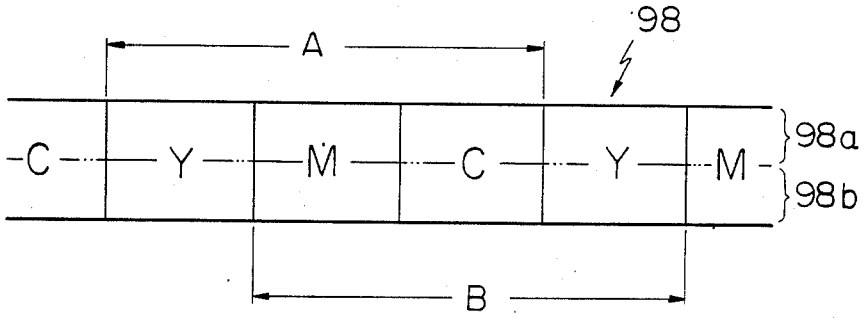
Fig. 5 PRIOR ART
FIG. 5 is an enlarged fragmentary view of a prior art color ink ribbon installed in a ribbon cartridge.

As shown in FIG. 5, an ink ribbon 98 applied to a color thermal printer, for example, is usually provided with a color ink pattern consisting of a yellow (Y) region, a magenta (M) region and a cyan (C) region, each extending over the whole width of the ribbon. This three-color pattern repeats itself throughout the length of the ribbon. In operation, the color ink ribbon 98 is fed at first in one direction as indicated by arrow A to use its upper portion 98*a* and, in this instance, the colors appear at the print position in a pattern or sequence of "YMC". However, while the ribbon 98 is fed in the other direction as indicated by an arrow B to use its lower portion 98*b* after positioning the cassette upside down, the colors appear in a pattern or sequence of "YCM" which is different from the previous pattern of "YMC". To print out data in purple, for example, it is the usual practice to print out magenta (M) first and, then, cyan (C) over the magenta (M). After the cartridge has been turned upside down, however, cyan (C) is printed out first and, then, magenta (M) over the cyan (C). Purple provided by printing out cyan (C) over magenta (M) and purple provided by printing out the latter over the former are delicately different in tone from each other. Such is undesirable from the printout quality standpoint.

Figure 6:
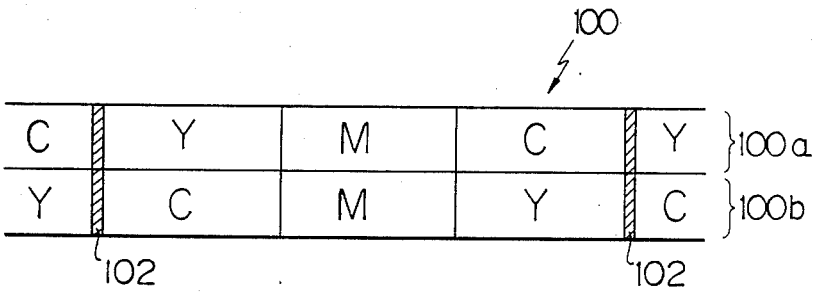
FIG. 6 and FIG. 7 are enlarged fragmentary views of color ink ribbons in accordance with the present invention.

Referring to FIG. 6, a color ink ribbon in accordance with the present invention is shown which constitutes a solution to the problem discussed above. The color ink ribbon 100 shown in FIG. 6 is applicable to a color thermal printer, for example. In this particular embodiment, the ribbon 100 has an upper part and a lower part each of which extends along the length of the ribbon 100. In each of the upper and lower ribbon parts, a pattern provided by ink of different colors repeatedly appears. The colors may be, but are not limited to, yellow (Y), magenta (M) and cyan (C) as illustrated. Specifically, as shown in FIG. 6, the color pattern in the upper part 100*a* of the ribbon 100 is "YMC" from the left to the right, while the color pattern in the lower part 100*b* is "YMC" from the right to the left. Further, the ribbon 100 is provided with marks 102, each intervening between neighboring cyan (C) and yellow (Y) colors.

Figure 7:
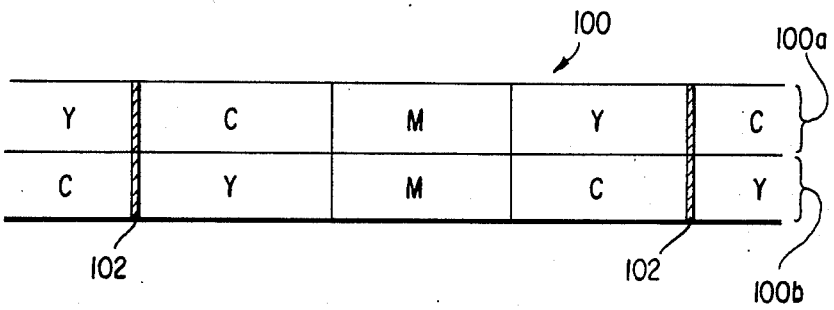

An embodiment similar to that of FIG. 6 is shown in FIG. 7, the difference being that the colors appear in the reverse order.

As previously described, the ink ribbon 100 is received in the ribbon cartridge 40 and loaded in a carriage of a printer. In operation, the ribbon 100 is fed by the endless ribbon feed belt 66. A color discriminator which is independent of the ribbon end sensor 76 or 84 and may also be positioned in the right shoulder portion 74 of the cartridge 40 senses marks 102 of the ribbon 100 to identify the colors. At first, dataa are prined out in a paper, which is wrapped around a platen, using either one of the upper part 100*a* and the lower part 100*b* of the ribbon 100. After the ink ribbon 100 is taken up on the takeup core 62, the cartridge 40 is turned over to use the other or fresh one of the upper part 100*a* and lower part 100*b*.

While the ribbon 100 of the present invention has been shown and described in relation to a color thermal printer, it is similarly applicable to a daisy printer, a dot printer and other various kinds of printers or even to other classes of recording machines.

Further, although the description has concentrated on an ink ribbon which is received in a ribbon cartridge, the ribbon may even be of the type which is not housed in a cartridge but simply wound around ribbon spools that are detachably loaded in a printer.

It will be seen from the above that where the ink ribbon in accordance with the illustrative embodiment is used and reciprocated to use its upper and lower parts in sequence, the colors on the ink ribbon always appear in the same pattern with no regard to the direction of ribbon feed. This uniformalizes tints of the colors without reducing the effective number of printouts per unit length of the ribbon in the reciprocal feed mode.

Obviously, numerous modifications and variations of the present invention are possible in light of the above teachings. It is therefore to be understood that within the scope of the appended claims, the invention may be practiced otherwise than as specifically described herein.

What is claimed is:

1. An ink ribbon cartridge which is reversibly loaded in a printer, provided with an ink ribbon having a width great enough to accommodate at least two characters and used to print out characters using upper and lower parts thereof in sequence, comprising:

a case having, assuming that a position where the ink ribbon makes contact with a head of the printer is an upper portion of said casing, right and left portions which are configured substantially symmetrically with respect to a central plane passing through said cartridge;

a color ink ribbon comprising a repetitive pattern of different colors of ink disposed in a first order of colors along an upper portion of the length of the ribbon and a repetitive pattern of the same colors of ink disposed in a second order of colors along a lower portion of the length of the ribbon, said first order of colors being opposite to said second order of colors;

an ink ribbon feed core provided in said casing for storing the ink ribbon which is wound around said feed core;

an ink ribbon takeup core provided in the casing for taking up the ink ribbon which is paid out from said ink ribbon feed core;

a ribbon feed belt for moving the ribbon, the feed belt being frictionally engaged with outer peripheries of the ink ribbon which is wound around said cores;

a belt drive roller for imparting a drive force to said ribbon feed belt; and a pair of belt feed rollers each located in a position to cooperate with said belt drive roller to maintain the belt in frictional contact with the outer peripheries of the ink ribbon which is wound around the cores.

2. An ink ribbon cartridge as claimed in claim 1, wherein the belt drive roller is located in a substantially central portion of the casing, the pair of belt feed rollers being located in substantially symmetrical positions with respect to the belt drive roller such that the belt feed rollers and the belt drive roller define apexes of a triangle, whereby the ink ribbon is driven by a force applied to the cartridge at a substantially central portion thereof.

3. An ink ribbon cartridge as claimed in claim 2, wherein the casing includes a right shoulder portion and a left shoulder portion which are disposed substantially symmetrical with respect to each other in the right-left direction of the cartridge.

4. An ink ribbon cartridge as claimed in claim 3, further comprising ribbon end sensor means provided in one of said left and right shoulder portions for sensing an end of the ink ribbon.

5. An ink ribbon cartridge as claimed in claim 4, wherein said ribbon end sensor means comprises housing portions, located to face each other across a space in which the ribbon is movable, for housing a light-emitting element and a light-sensitive element, respectively.

6. An ink ribbon cartridge as claimed in claim 5, further comprising a cover engageable with the casing to isolate an interior of the casing from an exterior.

7. An ink ribbon cartridge as claimed in claim 6, wherein said cover has a right shoulder portion and a left shoulder portion which are disposed substantially symmetrical with respect to each other in the right-left direction of the cartridge.

8. An ink ribbon cartridge as claimed in claim 7, further comprising second ribbon end sensor means provided in the other shoulder portion opposite to the shoulder portion where the first-mentioned ribbon end sensor means is located, when the cover and the casing are engaged with each other.

9. An ink ribbon cartridge as claimed in claim 8, wherein the color ink ribbon comprises marks respectively disposed between the repetitive patterns which neighbor each other in the lengthwise direction of the ribbon for discriminating predetermined ones of the colors.

10. An ink ribbon cartridge as claimed in claim 9, further comprising color ink discriminator means for sensing the marks.

11. An ink ribbon cartridge as claimed in claim 10, wherein said color ink discriminator means is provided in each of the opposite shoulder portions of the casing and the cover.

12. An ink ribbon cartridge as claimed in claim 11, wherein the ribbon end sensor means comprises means for sensing the marks.

13. A color ink ribbon received in an ink ribbon cartridge which is reversibly loaded in a printer and having a width great enough to accommodate at least two characters, comprising:

a repetitive color pattern provided in an upper part of the ribbon in which different colors of ink are arranged in a first order of colors along a length of the ribbon; and a repetitive color pattern provided in a lower part of the ribbon in which the same colors of ink are arranged in a second order of colors which is opposite to the order of the colors of the upper part.

14. A color ink ribbon as claimed in claim 13, further comprising marks respectively disposed between the repetitive color patterns which neighbor each other in the lengthwise direction of the ribbon for discriminating predetermined ones of the colors.

15. A color ink ribbon as claimed in claim 14, wherein in the repetitive color pattern in the upper part of the ribbon, the colors are yellow (Y), magenta (M) and cyan (C) and the colors are sequentially arranged in that order from the right to the left in the lengthwise direction of the ribbon, the colors in the repetitive color pattern in the lower part being yellow (Y), magenta (M) and cyan (C) arranged from the left to the right in that order.

16. A color ink ribbon as claimed in claim 15, wherein in the repetitive color pattern in the upper part of the ribbon, the colors are yellow (Y), magenta (M) and cyan (C) and the colors are sequentially arranged in that order from the left to the right in the lengthwise direction of the ribbon, the colors in the repetitive color pattern in the lower part being yellow (Y), magenta (M) and cyan (C) arranged from the right to the left in that order.

* * * * *